United States Patent [19]

Riley et al.

[11] 3,985,658

[45] Oct. 12, 1976

[54] EXTINGUISHING AGENT FOR COMBUSTIBLE METAL FIRES

[75] Inventors: John F. Riley, Menominee; Edgar Eugene Stauffer, Wallace, both of Mich.

[73] Assignee: The United States of America as represented by the United States Energy Research and Development Administration, Washington, D.C.

[22] Filed: Apr. 16, 1975

[21] Appl. No.: 568,764

[52] U.S. Cl. ..... 252/7; 169/47

[51] Int. Cl.[2] ..... A62D 1/00

[58] Field of Search ..... 252/5, 7; 169/1 A

[56] References Cited

UNITED STATES PATENTS 3,608,641 9/1971 Cottrell ..... 252/7 X

*Primary Examiner*—Stephen J. Lechert, Jr.

*Attorney, Agent, or Firm*—Dean E. Carlson; F. A. Robertson; Irene S. Croft

[57] ABSTRACT

A low chloride extinguishing agent for combustible metal fires comprising from substantially 75 to substantially 94 weight percent of sodium carbonate as the basic fire extinguishing material, from substantially 1 to substantially 5 weight percent of a water-repellent agent such as a metal stearate, from substantially 2 to substantially 10 weight percent of a flow promoting agent such as attapulgus clay, and from substantially 3 to substantially 15 weight percent of a polyamide resin as a crusting agent.

10 Claims, No Drawings

EXTINGUISHING AGENT FOR COMBUSTIBLE METAL FIRES

BACKGROUND OF THE INVENTION

The invention described herein was made in the course of, or under, Purchase Order Number H388-0016P to The Ansul Company under United States Energy Research and Development Administration Contract No. AT(04-3)-700 with North American Rockwell Corporaion.

This invention relates to a finely divided, fire extinguishing agent for use on combustible metal fires, particularly, sodium, potassium, and sodium-potassium alloy fires. More specifically, this invention relates to a low chloride fire extinguishant for combustible metal fires.

The increased use of combustible metals, such as sodium, potassium, calcium, lithium, magnesium, and the like, has increased the need for a noncombustible extinguishing agent which can be applied in a controlled stream from a nozzle to control and extinguish both spill type and in-depth type fires. In sodium fires, for example, combustion of sodium in air results in the formation of sodium peroxide and to a lesser extent sodium oxide. It is believed that two-thirds of the combustion reaction occurs in the vapor phase and one-third at the metal surface. The rate of reaction is controlled by the rate of vaporization of sodium and the rate of diffusion of oxygen into the combustion zone. Thus, the reaction rate for a spill or in-depth fire will be relatively slow compared to a spray of sodium metal because of the higher specific surface area and, therefore, higher rates of vaporization of sodium. In light of these factors, agents for the extinguishment of sodium fires have evolved that effect extinguishment by separation of the metal suface from oxygen and by reducing the temperature of the metal, thereby reducing the rate of vaporization.

One fire extinguishing composition which has been proposed for combatting combustion metal fires comprises sodium chloride as the base agent and contains a chlorinated polymer as a binder, as described in U.S. Pat. No. 2,937,990, issued May 24, 1960. However, a potential problem inherent in the use of chloride-containing extinguishants is the strong possibility of chloride stress corrosion in austenitic stainless steel. Because of the high operating temperatures (1000° – 1200° F) encountered in component test and heat transfer equipment, rapid rates of chloride stress corrosion would be expected. Therefore, an effective extinguishant containing the lowest chloride content as is practical is highly desirable.

SUMMARY OF THE INVENTION

In accordance with the present invention, it has been found that a minor proportion of a polyamide resin, used in conjunction with sodium carbonate as the basic fire extinguishing material, forms an effective crust or matrix of $Na_2CO_3$ on the surface of the metal and separates the metal from the oxidizing agent (air). The polyamide resin effectively prevents the denser sodium carbonate from sinking into the less dense metal.

Therefore, it is an object of the present invention to provide a free-flowing, low chloride, fire extinguishing agent for combustible metal fires.

More particularly, it is an object of this invention to provide a free-flowing, carbonate based extinguishant for sodium, potassium, and sodium-potassium alloy fires.

Other objects of the invention will become apparent from the following detailed description.

DETAILED DESCRIPTION OF THE INVENTION

The present invention provides a free-flowing, finely divided composition for extinguishing fires in air-combustible metals comprising from substantially 75 to substantially 95 weight percent of sodium carbonate as the basic fire extinguishing material, from substantially 1 to substantially 5 weight percent of a water-repellent agent, from substantially 2 to substantially 10 weight percent of a flow promoting agent, and from substantially 3 to substantially 15 weight percent of a polyamide resin as a crusting agent.

The sodium carbonate used in the present composition is preferably anhydrous sodium carbonate, commonly known as soda ash. Preferably, the amount used is in the range of from substantially 8 to substantially 94 weight percent, specifically, of the order of 89 – 90 weight percent.

The use of sodium carbonate in fire extinguishing apparatus by projection under pressure calls for a free running powder which does not agglomerate during storage. Since sodium carbonate is by nature hygroscopic, it is necessary to treat this salt with a water-repellent agent. The water-repelling agent may consist of any suitable material such as metallic soaps of fatty acids, preferably stearic acid. The preferred water-repellent agents are the alkali metal and alkaline earth metal salts of stearic acid, specifically lithium stearate, sodium stearate, and magnesium stearate. Sodium stearate, being the least costly, is preferred. The preferred quantity of water repellent is of the order of 2 – 3 weight percent although the amount can vary between about 1 and about 5 weight percent. The water-repellent agent may be added to the fire extinguishing composition simply by mixing. The agent can also be applied in a solution with a volatile solvent, or the extinguishing composition can be exposed to the vapors of the agent.

The present fire extinguishing material is a finely divided solid material; however, a material which is too fine does not flow properly and tends to produce an agent which will drift away from the area to which it is being applied. The lower the median particle size, the more difficult it is to fluidize a material. Since the present agent is preferably to be used in a pressurized container, it is necessary to incorporate an additive which results in a composition that can be fluidized and, therefore, readily discharged from a pressurized fire extinguisher. Suitable flow promoters are known in the art and include such materials as mica, talc, tricalcium phosphate, fuller's earth, and attapulgus clay. The preferred fluidizing agent for the present extinguishing composition is attapulgus clay, from fine (at least 85% passing through a 325 mesh screen) to coarse (40% maximum passing through a 200 mesh screen). The amount of flow promoter used may vary between about 2 to about 10 weight percent; larger quantities may interfere with the properties of the composition, for example, by increasing bulkiness or by inhibiting the crusting action of the resin.

The density of sodium at 1200° F is approximately 0.7 gm/cm$^3$, while that of sodium carbonate is 2.5 gm/cm$^3$. As a result of this density difference, sodium carbonate tends to sink into the sodium metal. In order to prevent such an occurrence, it is necessary to add an agent having a lower density and a low softening temperature which would, on contact with the hot sodium, form a matrix or crust of $Na_2CO_3$ on the surface of the sodium, thereby separating the fuel (Na) from the oxidizing agent (air).

Applicants have found that polyamide resins of the type known generically as "nylon" are especially effective crusting agents when used in conjunction with sodium carbonate. Nylon, as defined in Floyd, *Polyamide Resins*, 2nd Ed., Reinhold Publishing Corp., N.Y., page 1, is a generic term for any long-chain synthetic polymeric amide which has recurring amide groups as an integral part of the main polymer chain and which is capable of being formed into a filament in which the structural elements are oriented in the direction of the axis. The most commonly utilized nylons are nylon-11; nylon-6,6; and nylon-6 which are described in detail in the cited reference. These materials are self-extinguishing and are particularly suitable for use in the present fire extinguishing composition. The quantity of nylon used may vary; however, large quantities may affect the flow properties of the fire extinguishant. The preferred amount is of the order of about 5% by weight, but the amount may vary between about 3 and about 15 weight percent.

The test results given in Table I demonstrate the superiority of nylon polyamide resins, when used in conjunction with $Na_2CO_3$, as compared with other polymeric materials used with $Na_2CO_3$. The test procedure using a 12 in$^2$ steel pan, 1.5 in deep, was as follows: (1) Heat pan for 10 minutes to insure dryness. (2) Heat to ignition 60 grams of sodium metal. (3) Remove heat source and allow flame to cover surface. (4) Manually apply agent uniformly over surface. (5) Monitor burnthrough resistance for 10 minutes and record weight of agent used. To be acceptable, a formulation had to extinguish the fire with no burnthrough, no secondary fires from decomposition products, and have an efficiency of about 1.0. To have a borderline rating, a formulation had to extinguish the fire, have only minimal burnthrough and/or secondary fires from decomposition products and have an efficiency of 1.2 or less. A not acceptable rating indicates that burnthrough occurred. For purposes of reference, the following formulation was used as the control and assigned an efficiency of 1.0: NaCl — 86 wt %, copolymer of vinylidene chloride and acrylonitrile — 7 wt %, Mg Stearate — 2 wt %, and attapulgus clay — 5 wt %.

TABLE I

| % $Na_2CO_3$ | Type/% Flow Promoter | Type/% Polymer | Wt. of Agent | Gm. Agent Gm. Na | Efficiency | Comment |
|---|---|---|---|---|---|---|
| 91 | Mg Stearate 2% | Nylon-6,6 7% | 35 | .59 | .66 | Acceptable |
| 91 | Aluminum Octoate 2% | Nylon-6,6 7% | 35 | .59 | .66 | Acceptable |
| 91 | Mg Stearate 2% | Acryloid* 7% | 37 | .62 | .69 | Not Acceptable |
| 91 | Aluminum Octoate 2% | Acryloid* 7% | 42 | .70 | .78 | Not Acceptable |
| 91 | Mg Stearate 2% | Lucite** 7% | 57 | .94 | 1.04 | Not Acceptable |
| 91 | Mg Stearate 2% | Dyalite*** 7% | 50 | .83 | .92 | Not Acceptable |
| 91 | Li Stearate 2% | Dyalite*** 7% | 80 | 1.33 | 1.47 | Not Acceptable |

*A commercial acrylic ester resin
**A comercial polymethylmethacrylate
***A commercial polystyrene The ingredients of the present fire extinguishing composition are mixed in finely divided form or ground together by any suitable means to produce a homogeneous free-flowing composition having, preferably, the particle size analysis as shown in Table II.

TABLE II

| Sieve No. | Wt. % Retained |
|---|---|
| 140 | About 65 – 80 |
| 200 | About 0 – 10 |
| 325 | About 0 – 10 |
| Pan | About 15 – 25 |

EXAMPLE

A fire extinguishing agent having the following composition (by weight) was formulated by mixing in suitable blending apparatus:

| |
|---|
| 90% $Na_2CO_3$ |
| 2% sodium stearate |
| 3% attapulgus clay |
| 5% nylon-6,6 |

The composition had the following particle size analysis:

| Percent Retained on Sieve No. | | | |
|---|---|---|---|
| 140 | 200 | 325 | Pan |
| 69.0 | 8.5 | 8.7 | 13.8 |

The above formulation was tested in accordance with Underwriter's Laboratories Standards 299 and 711 in standard commercial 30-pound, 150-pound, and 350-pound fire extinguishers and was approved and listed in this equipment as well as for hand scoop application for sodium fires at a fuel temperature of 1200° F. The agent was also successfully tested at a fuel temperature of 1500° F.

The above composition was also tested for toxicological effects. It was concluded that the product as prepared for use would not have any serious toxicological effect. The fumes liberated consisted mainly of carbon dioxide with some amines possible. They are not considered serious from a toxicity standpoint. It is not suspected that any serious reaction would occur if the agent were used on any other combustible metal.

The composition of the present invention flows freely and can be applied on combustible metal fires from a safe distance. The agent may be applied by hand scoop or shovel or it may be applied using pressurized fire extinguishers. The method of application is basically the same whether using an extinguisher, scoop, or shovel. The agent is gently deposited over the entire surface of the burning metal to form a crust which isolates the molten metal from the atmosphere, extinguishing the fire and allowing the metal to cool below its ignition temperature.

Although the present invention has been described with reference to specific examples, it will be understood that various modifications and changes can be made without departing from the true spirit and scope of the invention. Thus, it is not intended to limit the invention except by the terms of the following claims.

What we claim is:

1. A finely divided, fire extinguishing composition for air-combustible metal fires comprising from substantially 75 to substantially 94 weight percent of sodium carbonate, from substantially 1 to substantially 5 weight percent of a water-repellent agent, from substantially 2 to substantially 10 weight percent of a flow promoting agent, and from substantially 3 to substantially 15 weight percent of a polyamide resin as a crusting agent.

2. A composition according to claim 1 wherein the water-repellent agent is a metallic salt of a fatty acid.

3. A composition according to claim 2 wherein the metallic salt of a fatty acid is a stearic acid salt of an alkali or alkaline earth metal.

4. A composition according to claim 1 wherein the flow promoting agent is attapulgus clay.

5. A composition according to claim 1 wherein the water-repellent agent is an alkali metal or alkaline earth metal salt of stearic acid, the flow promoting agent is attapulgus clay, and the polyamide resin is a nylon polyamide.

6. A finely divided, fire extinguishing composition for air-combustible metal fires containing sodium carbonate, sodium stearate, attapulgus clay and nylon-6,6 in substantially the following proportions by weight: sodium carbonate, 90%; sodium stearate, 2%; attapulgus clay, 3%; and nylon-6,6, 5%.

7. A method of fighting an air-combustible metal fire which comprises applying to the fire a composition comprising from substantially 75 to substantially 94 weight percent of sodium carbonate, from substantially 1 to substantially 5 weight percent of a water-repellent agent, from substantially 2 to substantially 10 weight percent of a flow promoting agent, and from substantially 3 to substantially 15 weight percent of a polyamide resin as a crusting agent.

8. A method according to claim 7 wherein the water-repellent agent is an alkali metal or alkaline earth metal salt of stearic acid, the flow promoting agent is attapulgus clay, and the polyamide resin is a nylon polyamide.

9. A method of fighting an air-combustible metal fire which comprises applying to the fire a composition comprising substantially 90 weight percent of sodium carbonate, substantially 2 weight percent of sodium stearate, substantially 3 weight percent of attapulgus clay, and substantially 5 weight percent of nylon-6,6.

10. A method according to claim 9 wherein the air-combustible metal fire is a sodium fire.

* * * * *